US011255145B2

(12) United States Patent
Rønne et al.

(10) Patent No.: US 11,255,145 B2
(45) Date of Patent: Feb. 22, 2022

(54) PLUG RETRIEVAL AND INSTALLATION MECHANISM

(71) Applicant: FMC Technologies, Inc., Houston, TX (US)

(72) Inventors: Simen Christian Florus Rønne, Houston, TX (US); Josué Vasconcelos Monteiro, Jr., Houston, TX (US); Lincoln Facundo, Houston, TX (US); H. Brian Skeels, Houston, TX (US); Ole Eddie Karlsen, Houston, TX (US); Luis Felipe, Houston, TX (US); Vidar Sten-Halvorsen, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 173 days.

(21) Appl. No.: 16/494,108

(22) PCT Filed: Oct. 13, 2017

(86) PCT No.: PCT/US2017/056493
§ 371 (c)(1),
(2) Date: Sep. 13, 2019

(87) PCT Pub. No.: WO2018/169566
PCT Pub. Date: Sep. 20, 2018

(65) Prior Publication Data

US 2020/0131872 A1 Apr. 30, 2020

Related U.S. Application Data

(60) Provisional application No. 62/471,655, filed on Mar. 15, 2017.

(51) Int. Cl.
*E21B 23/00* (2006.01)
*E21B 33/076* (2006.01)

(52) U.S. Cl.
CPC ..... *E21B 23/00* (2013.01); *E21B 33/076* (2013.01)

(58) Field of Classification Search
CPC ..... E21B 23/00; E21B 33/076; E21B 33/043; E21B 41/06; E21B 33/0355
See application file for complete search history.

(56) References Cited

U.S. PATENT DOCUMENTS 4,368,786 A * 1/1983 Cousins ..... E21B 4/04 175/61
4,658,916 A * 4/1987 Bond ..... E21B 7/061 138/130

(Continued)

FOREIGN PATENT DOCUMENTS

WO 97/04211 A1 2/1997
WO 97/43514 A1 11/1997
WO 2007/067786 A1 6/2007

OTHER PUBLICATIONS

Office Action issued in corresponding Australian Application No. 2017404517, dated May 13, 2020 (4 pages).

(Continued)

*Primary Examiner* — Steven A MacDonald
(74) *Attorney, Agent, or Firm* — Osha Bergman Watanabe & Burton LLP

(57) ABSTRACT

A rigid chain actuator (201) including a tool body (203) having a bore (204) with a chain (206) at least partially disposed in a housing (211) coupled to the tool body. Additionally, the rigid chain actuator includes a chain extension/retraction mechanism to extend the chain from the housing into the bore and recoil the chain from the bore into the housing. Furthermore, the chain may translate a force onto at least one wellbore tool through the bore.

17 Claims, 15 Drawing Sheets

(56) References Cited

U.S. PATENT DOCUMENTS

| | | | | | |
|---|---|---|---|---|---|
| 5,373,906 | A * | 12/1994 | Braddick | E21B 7/061 | 175/61 |
| 5,699,866 | A * | 12/1997 | Cousins | E21B 7/061 | 175/78 |
| 5,911,283 | A * | 6/1999 | Cousins | E21B 7/061 | 175/78 |
| 6,189,629 | B1 * | 2/2001 | McLeod | E21B 7/061 | 175/321 |
| 6,523,624 | B1 * | 2/2003 | Cousins | E21B 7/06 | 175/320 |
| 7,810,586 | B2 * | 10/2010 | Cousins | E21B 17/20 | 175/101 |
| 8,528,644 | B2 * | 9/2013 | Brunet | E21B 17/20 | 166/298 |
| 2008/0115940 | A1 * | 5/2008 | Brunet | E21B 43/112 | 166/298 |
| 2009/0127000 | A1 * | 5/2009 | Cousins | E21B 17/20 | 175/78 |

OTHER PUBLICATIONS

International Search Report issued in PCT/US2017/056493 dated Jan. 31, 2018 (4 pages).
Written Opinion issued in PCT/US2017/056493 dated Jan. 31, 2018 (6 pages).

* cited by examiner

PLUG RETRIEVAL AND INSTALLATION MECHANISM

FIELD OF THE DISCLOSURE

Embodiments disclosed herein relate to an apparatus and process for plug retrieval and installation during wellbore operations.

BACKGROUND

Subsea horizontal Christmas trees (HXT) or subsea vertical Christmas tree (VXT) are assemblies of valves, spools, fittings, and other components that isolate and redirect (control) the flow of oil or gas from a wellbore. HXTs or VXTs may commonly be referred to as a Christmas tree (XT) and may feature up to two crown plugs, installed in their tubing hangers or internal tree caps to seal the vertical production bore and redirect wellbore fluids during production. These plugs may be installed via wireline tools deployed through a vertical riser bore conduit. During a workover or well operation, it may be necessary to have full bore access through parts of the XT and into the well's production tubing which may otherwise be blocked by the crown plugs. Therefore, it is necessary to pull and retrieve the plugs prior to wellbore access operations.

By operational design, the crown plug's diameter needs to be larger than the wellbore tubing's inner diameter (ID) to provide a positive locating seat for the plug and still permit unrestricted access below. However, some large diameter crown plugs or internal tree caps (ITC) needed for larger production tubing string sizes may be too large to drift through the bores of well intervention systems, and their conduits, or well containment valves. The desire is to use the smallest bore well intervention system practical for well interventions to hold down well intervention system hardware costs and being able to use smaller (lower daily cost) surface vessels (ships) to workover a subsea well. Furthermore, some older style HXTs feature a solid ITC with diameters approaching the diameter of a subsea wellhead (up to 18½ inches (470 millimeters), forcing the need for much larger well intervention equipment and vessels all the way up to using a subsea BOP stack and drilling riser. Ready access to these larger bore systems (usually reserved for well drilling programs) along with their much higher associated operating rental costs may dissuade the economic justification for performing the workover.

Subsequently, removing solid ITCs or large diameter crown plugs from a XT forces a choice to perform the operation in an open water procedure, followed by installing and accessing the production tubing bore via a small bore well intervention system, vs. installing a larger bore well intervention system followed by removing the ITC or crown plug(s) through its bore. Performing open water runs has a high risk of wellbore fluids escaping into the subsea environment because well control equipment (barrier devices) are not present. Using intervention equipment with a larger bore diameter is time-consuming and expensive and may require a larger intervention vessel, and larger handling equipment to deploy and operate. Comparing two completion/workover riser systems having the same configuration, increasing the bore diameter by two inches may increase the weight by as much as thirty percent and increase the height by more than seven inches.

Additionally, to access and remove or re-install the crown plugs, a wireline running tool has to be lowered, reach through (across) the height of the XT and WCP in order to access the plug's below. Often, these running tools need to be lowered then anchored in some fashion to the wall bore of the XT or WCP in order to exert a pushing or pulling force to lock or unlock the crown plug, followed by retrieval of the running tool. Anchoring the tool in the machined bore of the XT or WCP in order to during repeated access and operation could incrementally damage the performance of the XT or WCP for each plug in the tree before any intervention work in the well can commence. The slack time associated with lowering and recovering the tool for each plug run can be greatly multiplied for deeper water depth subsea completions, which could be detrimental to the overall economics and logistics of the planned well intervention.

Furthermore, the extended slack time is further exacerbated when using a Riserless Light Well Intervention (RLWI) Stack. To run and retrieve the wireline tool, the RLWI's lubricator must be flushed from hydrocarbons before it can be opened up for tool access. This adds more steps, more time, and increased risk of pollution from procedural missteps as the lubricator is flushed and opened repeatedly.

SUMMARY OF THE DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, this disclosure relates to a rigid chain actuator including a tool body having a bore; a chain at least partially disposed in a housing coupled to the tool body; and a chain extension/retraction mechanism configured to extend the chain from the housing into the bore and recoil the chain from the bore into the housing; wherein the chain is configured to translate a force onto at least one wellbore tool through the bore.

In another aspect, this disclosure relates to a system including a proximal wellbore device; a wireline tool, disposed within the proximal wellbore device and configured to engage a plug, internal tree cap, or a wellbore tool; and wherein the wireline tool comprises at least one rigid chain actuator, connected to the proximal wellbore device, with a tool body having a bore; a chain at least partially disposed in a housing coupled to the tool body; and a chain extension/retraction mechanism configured to extend the chain from the housing into the bore and recoil the chain from the bore into the housing; wherein the chain is configured to translate a force onto at least one wellbore tool through the bore.

In another aspect, this disclosure relates to a method including actuating a chain of a rigid chain actuator; extending the chain from the rigid chain actuator into a wellbore device to install or retrieve a plug or tool in the wellbore device; and recoiling the chain into the rigid chain actuator to have access to the wellbore device.

Other aspects and advantages will be apparent from the following description and the appended claims.

DETAILED DESCRIPTION

Figure 1:
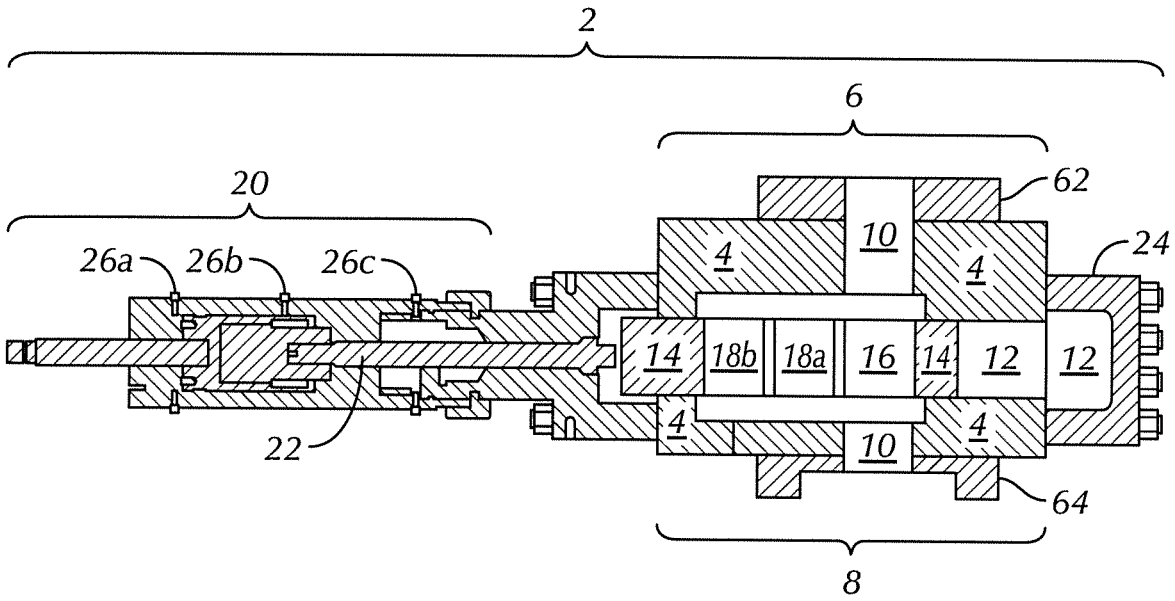
FIG. 1 is a cross-section view of a plug adaptor used in conjunction with the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As used herein, the term "coupled" or "coupled to" or "connected" or "connected to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification.

Embodiments disclosed herein generally relate to a plug retrieval and installation system for wellbore interventions and a method of performing wellbore interventions while using a plug adaptor. In some embodiments, the plug retrieval and installation device disclosed herein may be used following the method disclosed herein to remove one or more plugs from a wellbore device prior to a wellbore operation, store one or more plugs during a wellbore operation, and replace one or more plugs in a wellbore device after a wellbore operation.

FIG. 1 shows a plug adaptor 2 in accordance with the present disclosure. This plug adaptor 2 may be used in subsea wellbore operations. An adaptor body 4 may be attached to wellbore elements on a surface 6, for example, where surface 6 is proximal to the water surface and on a surface 8, for example, where surface 8 is distal to the water surface. An adaptor bore 10 may pass through the adaptor body 4 and may intersect the proximal surface 6 and the distal surface 8. The plug adaptor 2 may further include a shuttle chamber 12, which may intersect and be perpendicular to the adaptor bore 10. A shuttle 14 may be disposed within the shuttle chamber 12. The shuttle 14 may include two or more chambers. These chambers may include a through-bore and at least one receptacle. In an exemplary embodiment, the shuttle 14 may include three chambers which are a through-bore 16, a first receptacle 18*a*, and a second receptacle 18*b*, respectively. The shuttle chamber 12 may be configured such that the through-bore 16, the first receptacle 18*a*, and the second receptacle 18*b* may each be aligned with the adaptor bore 10. An actuator 20 may be used to translate the shuttle 14 within the shuttle chamber 12 to the desired alignment. The actuator 20 may be attached to the shuttle 14 via a shaft 22. The actuator 20 may translate the shuttle 14 between positions such that each of the chambers of the shuttle 14, including the through-bore 16, the first receptacle 18*a*, and second receptacle 18*b*, may be aligned with the adaptor bore 10. An access cover 24 may be disposed on a side of the adaptor body 4 opposite the actuator 20. The shuttle chamber 12 may extend to the end of the adaptor body 4 to allow access to the shuttle 14 when the access cover 24 is removed. The plug adaptor 2 is shown in a horizontal orientation. In some embodiments the plug adaptor 2 may be installed in a vertical orientation and function in a similar manner to that described herein.

The plug adaptor 2 may be a pressure containing body. The plug adaptor 2 may be designed to withstand high pressures and temperatures present in wellbore environments and to prevent wellbore fluids from escaping into the environment. The shuttle chamber 12 may be a pressure containing cavity and it may be maintained at the same pressure as surrounding wellbore elements. The shuttle 14 may not be pressure containing or pressure controlling. Thus, the shuttle 14 may not need to include seals or any means to control fluid flow through a chamber which is aligned or partially aligned with the adaptor bore 10.

As described above, the shuttle 14 may include at least two chambers. These chambers may include at least one through-bore 16 and at least one receptacle 18. A through-bore 16 may allow fluid flow through the plug adaptor 2 when the through-bore 16 is aligned with the adaptor bore 10. A plug from a wellbore device or a wellbore tool may be able to pass freely through the through-bore 16 when the through-bore 16 is aligned with the adaptor bore 10. A receptacle 18 may contain means for holding and releasing a plug or a wellbore tool. The means for holding and releasing a plug or wellbore tool may be a catch, diameter reduction, or other restriction within the receptacle 18 proximate the distal surface 8 of the adaptor body 4 or a spring mechanism or any other means known in the art. A receptacle 18 may or may not allow fluid flow through the plug adaptor 2 when the receptacle 18 is aligned with the adaptor bore 10. In some embodiments, a single chamber may be both a through-bore 16 and a receptacle 18. In some embodiments, each chamber may be only one of a through-bore 16 and a receptacle 18. The shuttle 14 may include any number of through-bores 16 and receptacles 18 such that the shuttle 14 includes two or more chambers. The through-bores 16 and receptacles 18 may be arranged in any order in the shuttle 14.

In some embodiments, one or more of the receptacles 18 may be a plug receptacle configured to hold a plug used in a wellbore device. A plug receptacle may hold a used plug that has been removed from a wellbore device or a new plug to be installed in a wellbore device. FIG. 1 illustrates an embodiment in which receptacles 18*a* and 18*b* may be plug receptacles.

In some embodiments, one or more of the receptacles 18 may be a tool receptacle configured to hold a tool used in wellbore operations. FIG. 1 illustrates an embodiment of the shuttle 14. The shuttle 14 may include three chambers which are a through-bore 16, a first receptacle 18*a*, and a second receptacle 18*b*, respectively. The receptacles 18*a* and 18*b* may be plug or tool receptacles. The first receptacle 18*a* may hold a brush tool, for example. The second receptacle 18*b* may hold a plug tool with an attached plug, for example. In some embodiments, both the first receptacle 18*a* and the second receptacle 18*b* may be configured to hold plugs, for example.

Figure 2:
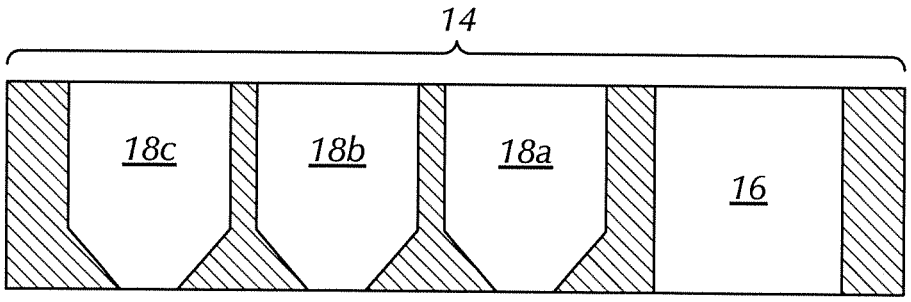
FIG. 2 is a cross-section view of a plug adaptor's shuttle used in conjunction with the present disclosure.

In some embodiments, one or more of the receptacles 18 may be a tool receptacle configured to hold a tool used in wellbore operations. FIG. 2 illustrates an embodiment of the shuttle 14. The shuttle 14 may include four chambers which are a through-bore 16, a first receptacle 18*a*, a second receptacle 18*b*, and a third receptacle 18*c*, respectively. The receptacles 18*a*, 18*b*, and 18*c* may be plug or tool receptacles. The first receptacle 18*a* may hold a prong tool with an attached prong, for example. The second receptacle 18*b* may hold a plug tool with an attached plug, for example. The third receptacle 18*c* may hold a brush tool, for example.

The chambers, including a through-bore 16 and a receptacle 18, may be disposed in the shuttle 14 such that when the shuttle 14 is disposed within the shuttle chamber 12, the chambers are parallel to the adaptor bore 10. There may be a clearance between the shuttle 14 and the shuttle chamber 12. In some embodiments, the shuttle 14 may be any shape known in the art and the shuttle chamber 12 may be any shape through which the shuttle 14 may be translated.

The shuttle 14 may be interchangeable. Multiple shuttles 14 may be designed for use with the plug adaptor 2. Different shuttles 14 may have chambers, including through-bores 16 and receptacles 18, of different sizes, but the shuttles 14 may all be designed to translate within the shuttle chamber 12. In this way, interchanging the shuttle 14 may allow the plug adaptor 2 to be used to remove, hold, and replace plugs and wellbore tools of different sizes. This may allow the plug adaptor 2 to be used in various wellbore operations with various wellbore devices. Removing the access cover 24 of the plug adaptor 2 may allow the shuttle 14 to be interchanged.

In some embodiments, the actuator 20 may be a pneumatic or hydraulic actuator. In some embodiments, the actuator 20 may include an electric motor and telescoping pistons. The pistons may be independently operable to reach different positions. In some embodiments, the actuator 20 may include a gear drive and a jackscrew mechanism. External mechanical rotary actuation may rotate the jackscrew which may in turn linearly drive the shuttle 14. External mechanical rotary actuation may be provided by a remotely operated vehicle, for example. In some embodiments, as shown in FIG. 1, the actuator 20 may include positive stops 26*a*, 26*b*, and 26*c* which indicate that a chamber of the shuttle 12 is aligned with the adaptor bore 10. In some embodiments, the plug adaptor 2 may communicate with a feedback device to indicate that the actuator 20 is configured such that a chamber of the shuttle 12 is aligned with the adaptor bore 10. The actuator 20 may be any means known in the art capable of translating the shuttle 14 within the shuttle chamber 12.

The proximal side 6 and the distal side 8 of the adaptor body 4 may be configured to be attached to wellbore elements. The wellbore elements may be attached such that a bore of each wellbore element is aligned with the central bore 10 of the adaptor body 4. In some embodiments, a proximal connector 62 and a distal connector 64 may be disposed on the proximal side 6 and the distal side 8, respectively, to facilitate the attachment of wellbore elements.

Figure 3:
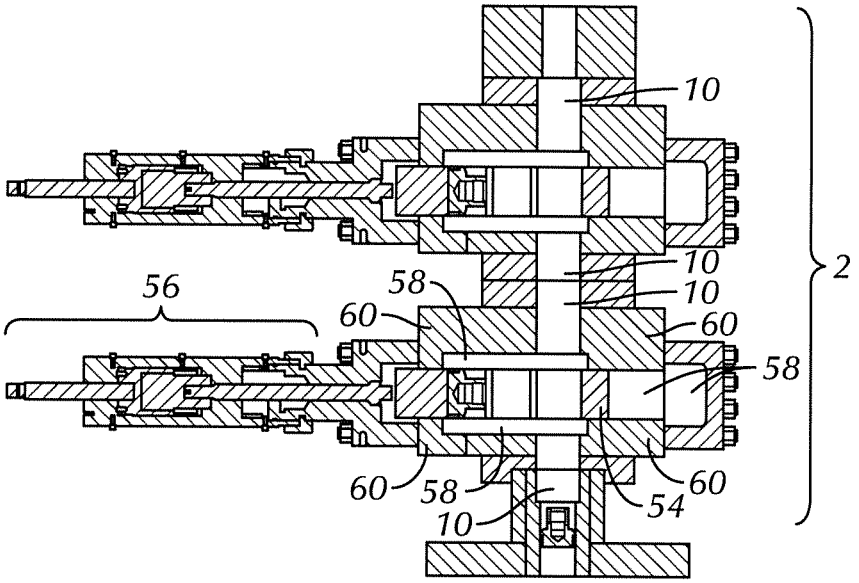
FIG. 3 is a cross-section view of a second embodiment of the plug adaptor used in conjunction with the present disclosure.

In some embodiments, as shown in FIG. 3, the plug adaptor 2 may include a second shuttle 54 actuated by a second actuator 56. The second shuttle 54 may be disposed in a second shuttle cavity 58 in a second adaptor body 60 or the second shuttle 54 may be disposed in the same shuttle cavity 12 or in a different shuttle cavity in the same adaptor body 4 as the first shuttle 14.

Figure 4:
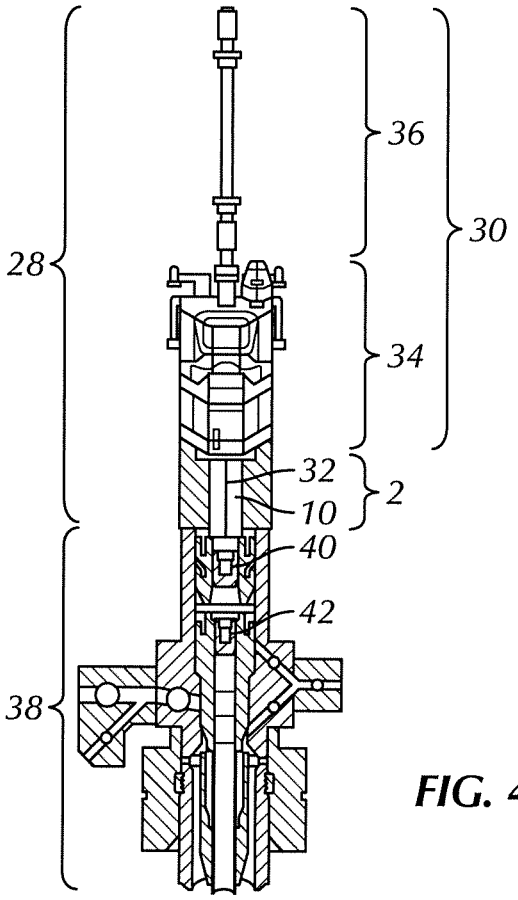
FIG. 4 is a partial cross-section view of a well intervention system including a plug adaptor in accordance with the present disclosure.

FIG. 4 shows a system 28 including the plug adaptor 2. The system may be used in wellbore operations. The system 28 may include the plug adaptor 2, a proximal wellbore device, which may be a subsea intervention system 30, and a wire line tool 32. The intervention system 30 may include a well control package (WCP) 34 and a riser conduit or lubricator 36 located above the WCP. The proximal side 6 of the adaptor body 4 may be attached between the WCP 34 and a Christmas tree (XT) 38 such that the bores of the WCP 34 and XT 38 are aligned with the adaptor bore 10.

In some embodiments, as illustrated in FIG. 4, the system 28 may be disposed on a distal wellbore device, which may be a horizontal Christmas tree (HXT) 38. The distal side 8 of the adaptor body 4 may be attached to the HXT 38, such that a bore of the HXT 38 is aligned with the adaptor bore 10. One or more plugs may be disposed within the HXT 38. In some embodiments, an upper crown plug 40 and a lower crown plug 42 may be disposed within the HXT 38. The upper crown plug 40 may be an upper crown plug and the lower crown plug 42 may be a lower crown plug. The plug adaptor 2 may be configured to remove, hold, and replace the plugs disposed within the HXT 38.

In some embodiments, the WCP 34 may be of any WCP configuration, including those as defined in API Standard 17G, for example. The WCP 34 may be used with a HXT 38. The inner diameter of the WCP 34 may be too small to allow crown plugs 40, 42 of the HXT 38 to pass through the WCP 34. The plug adaptor 2 may serve as an intermediate pressure containing housing to hold the one or more crown plugs 40, 42 which are too large to pass through the WCP 34. The plug adaptor 2 may allow a smaller subsea intervention system 30 to be used to adequately and safely remove and replace large bore crown plugs, thereby allowing access to the wellbore. In some embodiments, the subsea intervention system 30 may be a conventionally sized bored completion workover riser or a riserless light well intervention (RLWI) system. Further embodiments of the plug adaptor may be as described in in Provisional Application No. 62/471,655. Applicant also hereby incorporates by reference into this application U.S. Provisional Application No. 62/471,655.

The system 28 may be used to perform wellbore interventions including: plug profile cleaning, installation and retrieval of plugs and equalization stems, hydrate preventer displacement, Christmas tree installation, Christmas tree retrieval, logging, gauging, scale removal, acid treatment of a well, mechanical work in a well, and preparations for permanent plug and abandonment of a well. These interventions may require that one or more plugs 40, 42 be removed from the HXT 38 prior to the intervention and replaced in the HXT 38 after the intervention. In some embodiments, the system 28 may be used to perform any wellbore intervention known in the art.

In some embodiments, the system 28 may include the plug adaptor 2 and the wire line tool 32 in conjunction with other wellbore intervention devices. These wellbore intervention devices may include risers or any light well intervention device known in the art. In some embodiments, the system 28 may be disposed on a vertical Christmas tree.

Figure 5A:
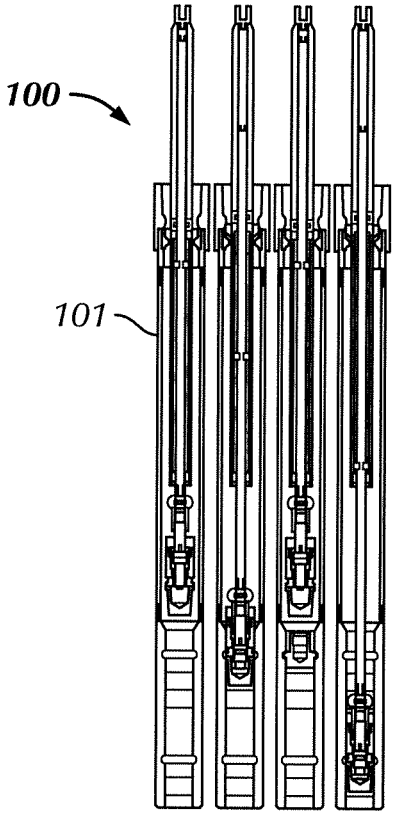
FIG. 5A (Prior Art)
FIGS. 5*a*-5*d* are side view operating sequences of a wireline tool anchoring and extending itself in accordance with one or more embodiments of the prior art.
Figure 5B:
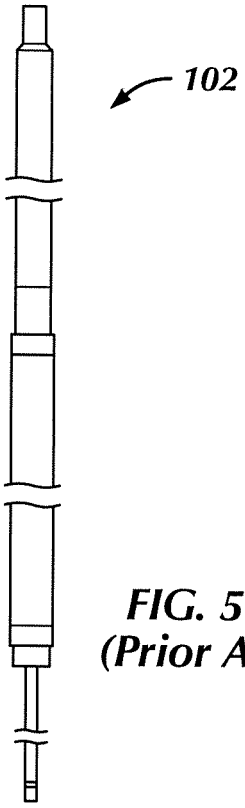
FIG. 5B (Prior Art)
Figure 5C:
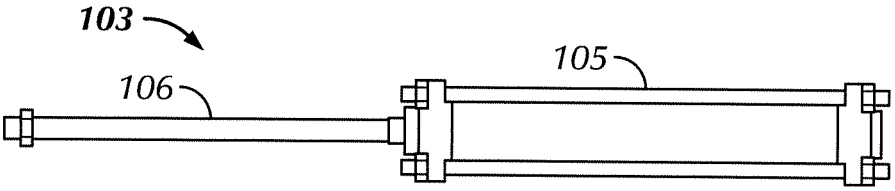
FIG. 5C (Prior Art)
Figure 5D:
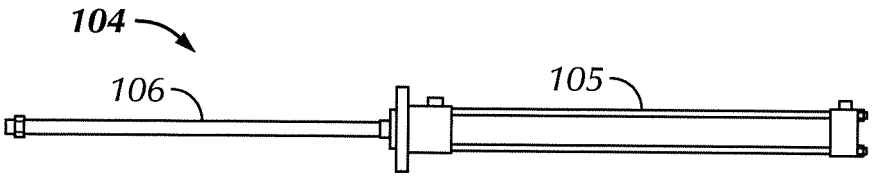
FIG. 5D (Prior Art)

As shown by FIGS. 5*a*-5*d*, many types of actuators known in the art may be used to actuate the wire line tool 32. The wire line runs for each tubing plug adding a pressure containing body below the WCP that houses a telescoping tool(s). The telescoping tool may be pneumatic cylinders and hydraulic cylinders. In FIG. 5*a*, a Halliburton DPR tool 101 of a pulling sequence 100 is illustrated. In a DPU tool pulling sequence 100, the DPR tool 101 is a battery powered electro-mechanical tool with a timer based logic. Additionally, the Halliburton DPR tool 101 moves up and down for a linear pull to a maximum 36 Inch Stroke with 60,000 Pound Force and Slow Linear Speed of ½" Per Minute. Furthermore, FIG. 5*b* shows a Weltec Stroker tool 102 which is similar to the Halliburton DPR tool 101. Both the Halliburton DPR tool and the Weltec Stroker tool 102 are an extending mechanism which is to be anchored into a wall of the HXT or VXT. However, in order to extend the Halliburton DPR tool and the Weltec Stroker tool 102 into the HXT, the Halliburton DPR tool and the Weltec Stroker tool 102 must be angled to the side of the pressure containing body. Additionally, FIGS. 5*c* and 5*d* show a typical pneumatic cylinder 103 and hydraulic cylinder 104 used to access the wireline tool.

HXT or VXT crown plugs typically have metal seals to fulfill long-term well containment requirements and as such require substantial setting or pulling force to install or retrieve the plugs. Therefore, the extending tool, as shown by FIGS. 5*a*-5*d*, also has to be able exert considerable axial force in its fully extended state. However, the extending tools need (see 101-104) to have a housing 105, which is the length of the reaching tool 106, to be able to perform their extend-force-retract function. Thus, when the extending tool is fully extended, the extending tool is double in length. In some cases, a reach distance of the extending tool needs to be inside the HXT or VXT to get at the lower crown plug may be over 10 feet. As such, this either makes the adapter body 20 feet long to encapsulate the extending tool or requires the tool to be housed in an angled side pocket extension on the side of the adapter body.

FIGS. 6*a*-6*f*, in one or more embodiments, shows a rigid chain actuator 107 that may be used to actuate the wire line tool 32 (See FIG. 4). The rigid chain actuator 107 includes a magazine housing 108, a chain extension/retraction mechanism 109, and a chain 110. The magazine housing 108 may be coupled to the chain extension/retraction mechanism 109 or the magazine housing 108 and the chain extension/retraction mechanism 109 may be integrated as one piece. In some embodiments, the chain extension/retraction mechanism 109 may be a hydraulic motor. Additionally, the chain extension/retraction mechanism 109 may be turned on, to extend or retract the chain 110, by a fixed hydraulic actuator (not shown) or an ROV torque tool (not shown). It is further envisioned that the fixed hydraulic actuator or ROV torque tool may directly extend and retract the chain 110 without using the chain extension/retraction mechanism 109. One with ordinary skill in the art would understand that the ROV torque tool is engaged by a remote operated vehicle (ROV). For example, the ROV torque tool (e.g., a screw driver, mechanical gears, etc.) may directly attached to the ROV or the rigid chain actuator 107 and the ROV engages the ROV torque tool or the rigid chain actuator 107 to extend or retract the chain 110. Additionally, a combination of the hydraulic motor, the fixed hydraulic actuator, and the ROV torque tool may be used to extend or retract the chain 110. Furthermore, the rigid chain actuator 107 is connected to the plug adapter (see FIG. 1) to allow crown plugs 117 or an internal crown tree (ITC) to be accessed and pulled. Additionally, the magazine housing 108 reduces the tool length by having a magazine 111 within the magazine housing for the chain 110 to be wrapped around in when recoiled. Further, gears (not shown) of the chain extension/retraction mechanism 109 are engaged with chain 110 to ensure the chain 110 is ready to actuated when needed. One with ordinary skill in the art will appreciate how the magazine housing 108 may be any shape needed to accommodate the chain 110. It is further envisioned that the chain extension/retraction mechanism 109 may be a rotary actuator. As such, a length of travel needed for the chain 110 to reach the crown plug 117 or ITC is accommodated by the magazine housing 108 and the chain extension/retraction mechanism 109. The chain 110 is wrapped around inside the magazine 111 and the chain extension/retraction mechanism 109 unrolls the chain 110 into a cavity of the plug adaptor. The rigid chain actuator 107 may be capable of moving large dynamic loads over large travel distances.

Additionally, the rigid chain actuator 107 may require less space compared to other types of actuators, including pneumatic cylinders 103 and hydraulic cylinders 104 shown in FIGS. 5*c*-5*d*. It is further envisioned that the magazine housing 108 and/or chain extension/retraction mechanism 109 may be insulated or formed from an insulation material. In one or more embodiments, a first end or portion 118 of the chain 110 may be attached to the chain extension/retraction mechanism 109, the magazine housing 108, or the magazine 111 to keep the chain 110 from being over extended or lost. Additionally, one skilled in the art will appreciate how the magazine housing 108 may be pressurized to have a tool pressure equal to or approximate to the internal pressure of a wellhead that the rigid chain actuator 107 is coupled to. By pressurizing the magazine housing 108, the rigid chain actuator 107 may require no or a reduced amount of seals needed to maintain pressure integrity.

Figure 6A:
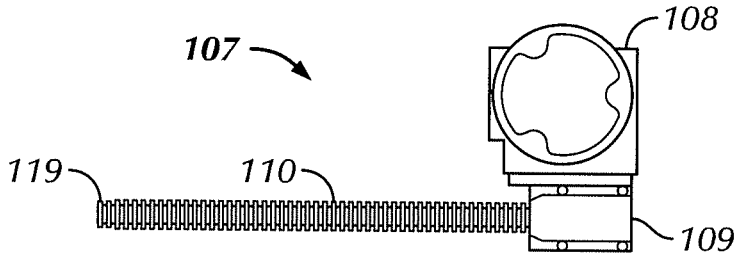
FIGS. 6*a*-6*g* are side views several embodiments of a rigid chain actuator in accordance with the present disclosure.
Figure 6B:
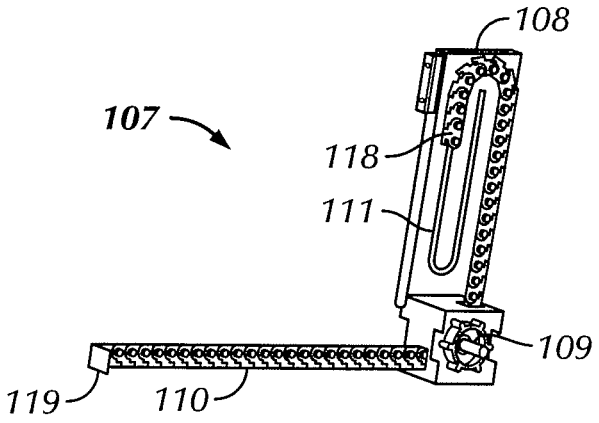
Figure 6C:
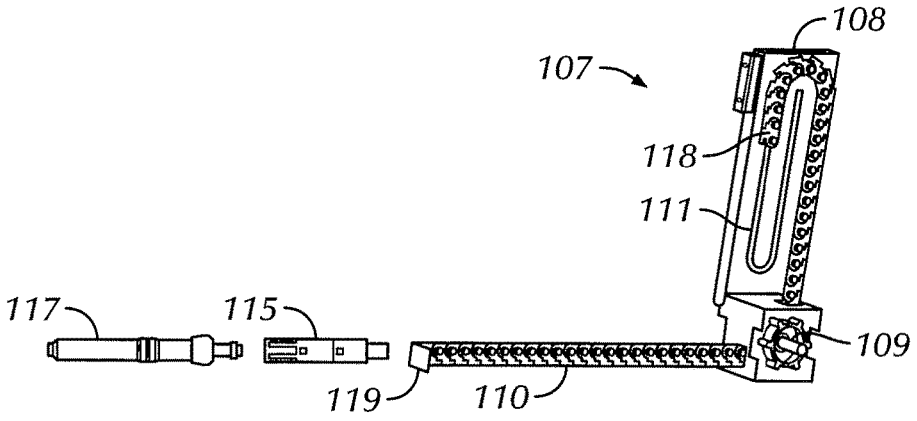
Figure 6D:
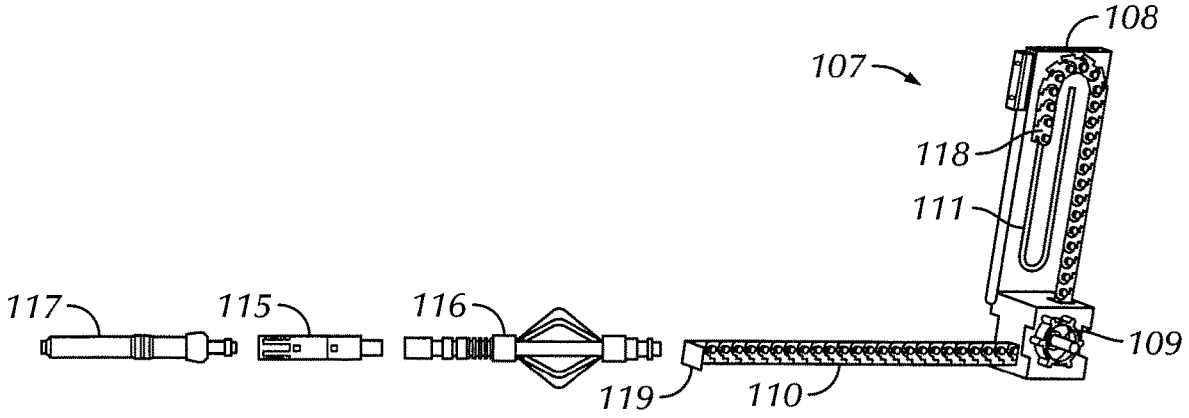
Figure 6E:
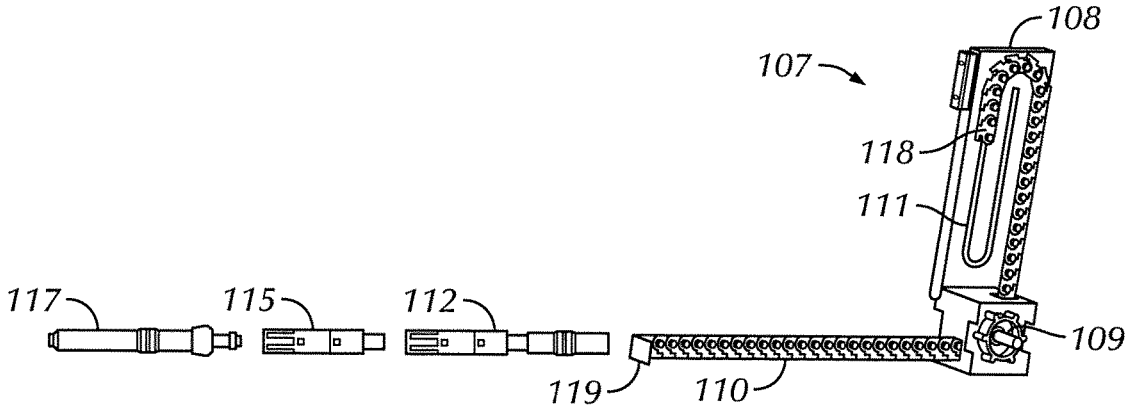
Figure 6F:
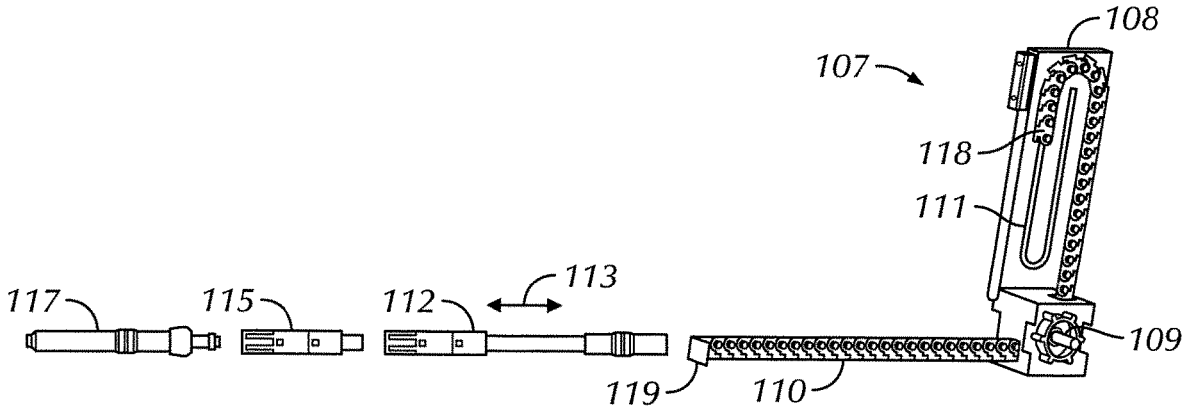
Figure 6G:
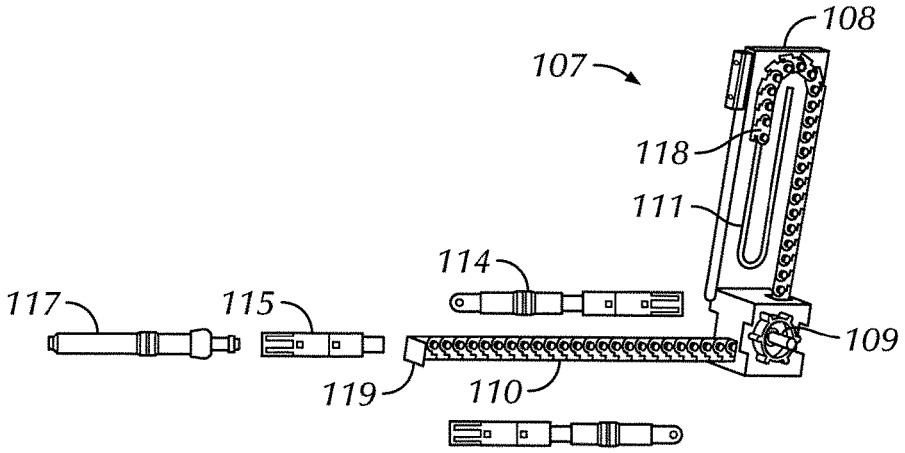

Further shown by FIGS. 6*c*-6*g*, in one or more embodiments, a second end 119 of the chain 110 may directly or indirectly engage to the crown plug 117 or ITC. For example, FIG. 6*d* shows the second end 119 may be connected to a centralizer 116 and the centralizer 116 is connected to a crown plug tool 115 which locks and unlocks the crown plug 117 or ITC. It is further environed that multiple centralizers 116 or centralizer plates may be used throughout the chain 110 to keep the chain 110 central to a bore the chain 110 is traveling through. Furthermore, one skilled in the art will appreciate how multiple centralizers 116 or centralizer plates may be spaced a certain distance apart from each other on the chain 110 to ensure the chain 110 does not buckle or limits the amount of buckle in the chain 110. Additionally, FIG. 6*c* shows the second end 119 may be directly connected to the crown plug tool 115. Additionally or alternatively, the second end 119 of the chain 110 may attach to multiple tools (brush tool, plug tool, centralizer, etc.), as noted above. For example, the chain 110 may use a brush tool for cleaning the crown plug 117, ITC, and/or the bore that the chain 110 is traveling past.

In one or more embodiments, the chain extension/retraction mechanism 109 may generate a linear force actuation capacity of roughly 10 tons (20000 pounds), and is limited by its torque capacity imparted through the chain 110 as the chain 110 is extended or retracted. In some embodiments, the rigid chain actuator 107 measures the force exerted by or one the chain 110 and/or the chain extension/retraction mechanism 109. In some instances, certain crown plug(s) 117 or ITC(s) may require up to 60000 pounds of insertion or pulling force. To increase the generated linear force, in one or more embodiment, a stroking device/tool 112 may be added to the second end 119 of the chain 110 or included somewhere in the rigid chain actuator 107. Once the chain 110 is in the extended position, the stroking device 112 circumferentially anchors itself to the wellbore wall to provide a structural reaction point. Then an internal mechanism mechanically (ball and jackscrew, hydraulic piston, etc.,) extends (see arrow 113) to generate the additional force necessary on the crown plug tool 115 to either lock or unlock the crown plug 117 or ITC. Alternately, the stroking device 112 may be a "lucker clamp style" reciprocating/ratcheting device 114 that directly contacts the chain 110 for added linear force up or down beyond what the chain extension/retraction mechanism 109 may deliver. It is further envisioned that the chain extension/retraction mechanism 109 or the chain 110 may have an additional force generating device attached to the motor 109 or be large enough to generate extra linear force without the stroking device 112. As such, one skilled in the art will appreciate how the rigid chain actuator 107 is a specialized mechanical linear actuator that may be used in wellbore applications as described herein. Additionally, the rigid chain actuator 107 may also be referred to as a chain and pinion device that forms an articulated telescoping member to transmit traction and thrust. Thus, the chain 110 may be a high-capacity rigid chain lifting columns (jacks) that may move dynamic loads exceeding 10 tonnes (20,000 lbs) over more than 7 meters (20 ft) of travel.

Now referring to FIGS. 7*a*-7*e*, in one or more embodiments, the chain 110 of the rigid chain actuator is illustrated. The chain 110 is made up of a plurality of links 120 specially shaped to fit into a preceding link 121 like a simple puzzle piece. The plurality of links 120 lock rigidly when a force is applied and remain locked until the force is released. In the locked position, axes 122 of the plurality of links 120 are aligned, forming a solid and rigid column 123 that can both push and pull. When unlocked, the plurality of links 120 are able to coil around the magazine in the magazine housing (i.e., a compact space). Furthermore, when the rigid column 123 is formed, the rigid column 123 may deflect (see arrows 124) from an X-axis by 10 to 30 mm. Additionally, rigid column 123 may deflect (see arrows 161) from a Y-axis by 2 mm. However, the rigid column 123 may experience no deflection or deflect more than 30 mm and still be intact. It is further envisioned that the chain 110 may include one or more centralizer plates (not shown) to reduce or eliminate buckling and deflection in the chain 110. Additionally, the centralizer plates may be integrated or attached to the chain 110. One skilled in the art will appreciate how the plurality of links 120 may be made from steel or another material having sufficient strength, tensile strength, flexural strength and other properties needed to perform the pushing and pulling operations described herein associated with various wellbore operations. It is further envisioned that the rigid chain actuator described herein may be equipped with a lubrication system (not shown) to ensure the chain and/or chain extension/retraction mechanism are properly lubricated.

Figure 7A:
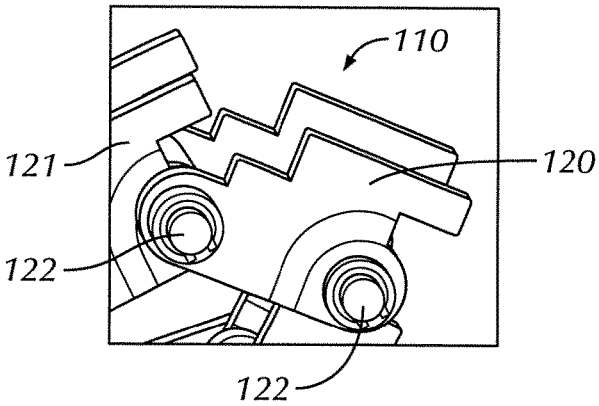
FIGS. 7*a*-7*h* are perspective views of a chain of the rigid chain actuator in accordance with the present disclosure.
Figure 7B:
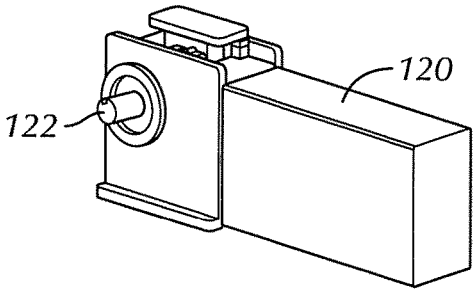
Figure 7C:
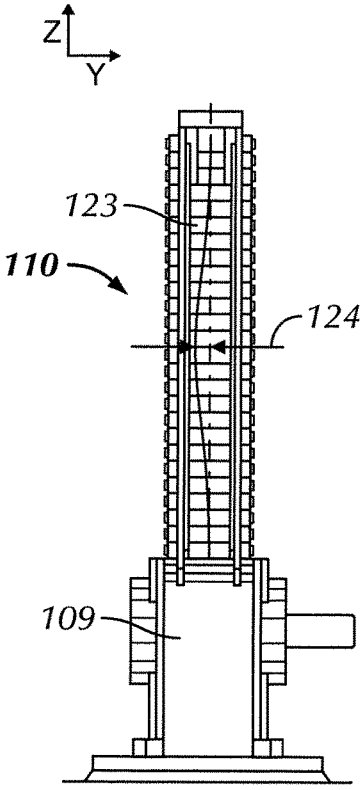
Figure 7D:
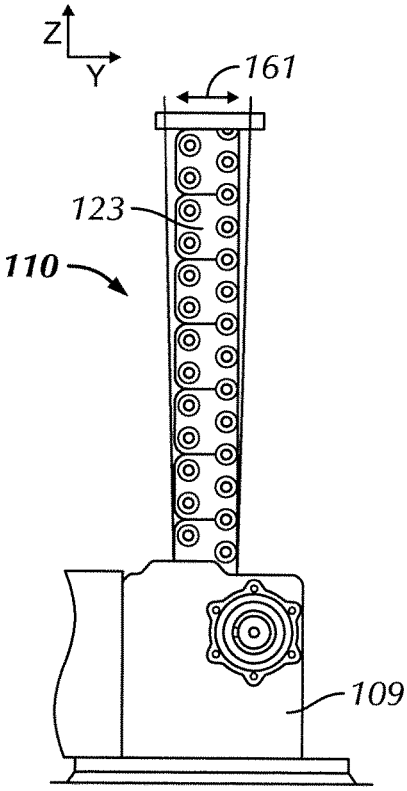
Figure 7E:
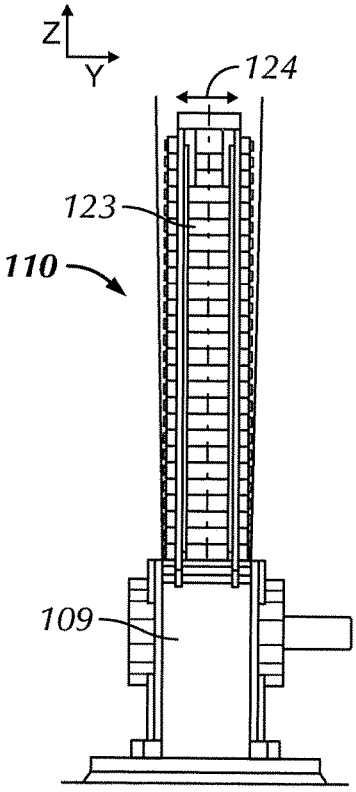
Figure 7F:
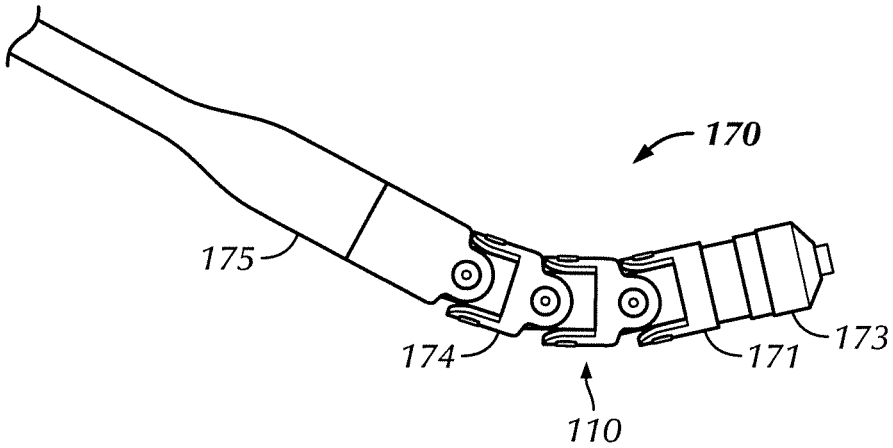
Figure 7H:
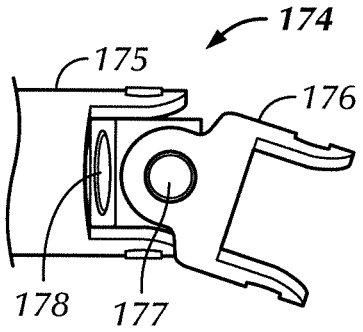
Figure 7G:
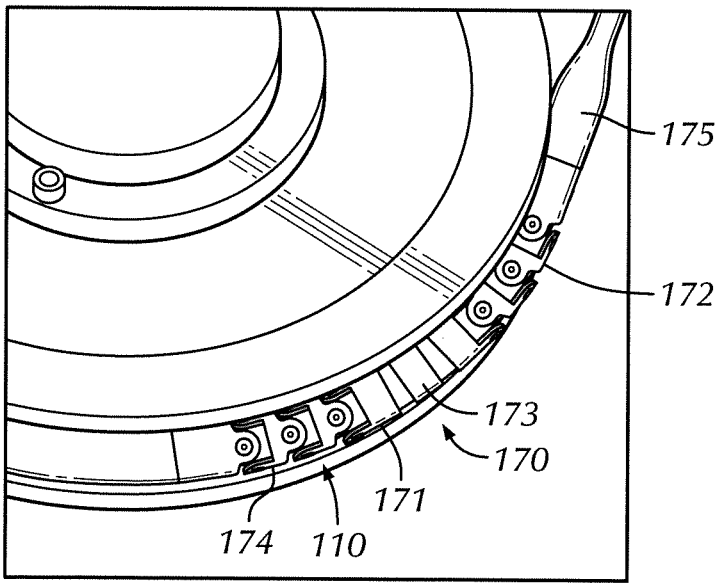

Referring to FIGS. 7*f*-7*h*, in one or more embodiments, the chain 110 of the rigid chain actuator is illustrated while bending. The chain 110 may include a bend restrictor 170. Furthermore, the bend restrictor 170 may be broken into a first joint 171 and a second joint 172. Additionally, each of the first joint 171 and the second joint 172 includes a connector 173 to join the two joints 171, 172 together. It is further envisioned that while the bend restrictor 170 is shown in two joints 171, 172, the bend restrictor 170 is not limited to joints and may be one or more joints. The bend restrictor 170 may be made up of a plurality of universal joints 174 to the chain 110 to bend through a restricted space (e.g. the magazine housing, the wellbore, etc.). It is further envisioned that the plurality of universal joints 174 may provide an adequate level of strain relief and bend restriction for the chain 110. In addition, the bend restrictor 170 may include a dry-mateable connector portion 175 suitable for deep water operation. Further shown by FIG. 7*h*, in one or more embodiments, the plurality of universal joints 174 may include a first U-joint 176 connected to a second U-Joint 177. Additionally, a mating portion 178 is designed to fit the first U-joint 176 to the second U-Joint 177. It is further envisioned that pins 179 are used to allow the first U-joint 176 to the second U-Joint 177 to move about an axis (not shown) relative to the mating portion 178.

One skilled in the art will appreciate how the bend restrictor 170 may be made from steel or another material having sufficient strength, tensile strength, flexural strength and other properties needed to perform the bending, pushing, and pulling operations described herein associated with various wellbore operations. For example, the bend restrictor 170 may have a operating tensile load up to or more than 267 kN (60,000 lbf), a dynamic cycle bend load up to or more than 50 kN (11,000 lbf), and have a connector insulation resistance greater than 100 MΩ at 500 VDC. Additionally, the bend restrictor 170 may be made from titanium, 17-4PH, bronze, or any combination thereof and the bend restrictor 170 may contain an elastomer such as polyurethane.

Figure 8:
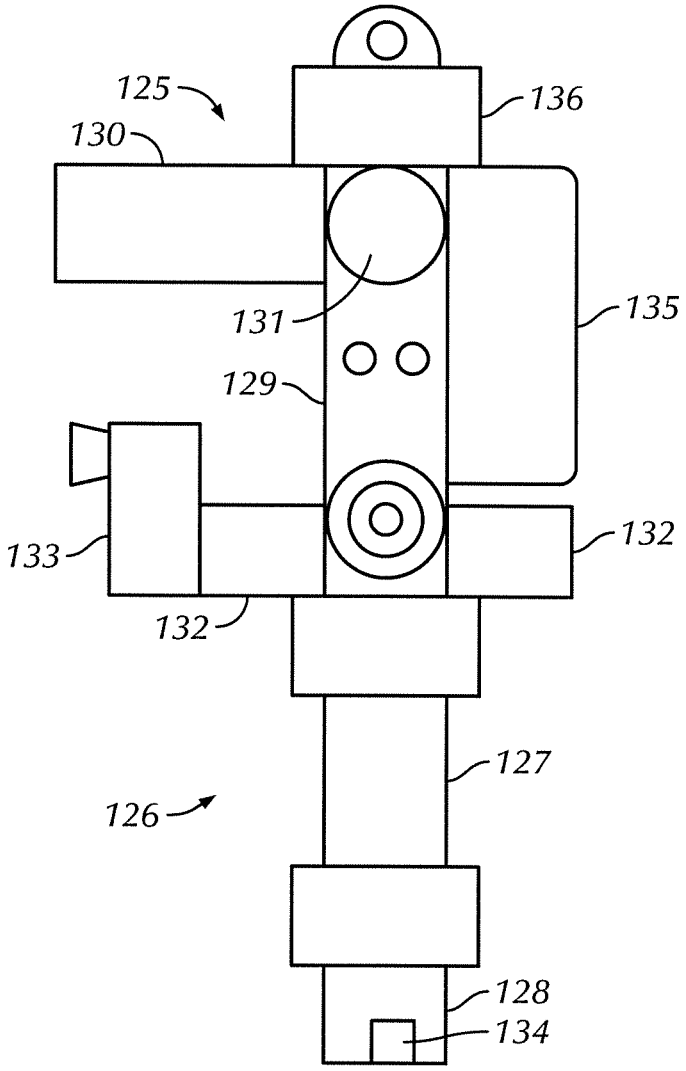
FIG. 8 is a block diagram of a rigid chain actuator incorporated into a well control package (WCP) in accordance with the present disclosure.

Referring to FIG. 8, FIG. 8 is a block diagram of a rigid chain actuator 125 in a well control package (WCP) 126, according to one or more embodiments herein. The WCP 126 includes a subsea vertical Christmas tree (VXT) 127 disposed on a wellhead 128 and above the VXT 127 is a plug adaptor 129. In some embodiments, the VXT 127 may be a subsea horizontal Christmas tree (HXT). As shown by FIG. 8, the rigid chain actuator 125 is coupled or integrated into the plug adaptor 129. In some embodiments, a release mechanism (not shown) is coupled to the rigid chain actuator 125 to independently remove the rigid chain actuator 125 from the WCP 126. For example, the release mechanism may be activated by a signal, an actuator, or an ROV to disengage the rigid chain actuator 125 for repair or replacement. Additionally, the magazine housing 130 is illustrated as on the side of the plug adaptor 129, but one of ordinary skill would appreciate how the magazine housing 130 is not limited to the side of the plug adaptor 129. Furthermore, the chain extension/retraction mechanism 131 of the rigid chain actuator 125 is within the plug adaptor 129 and connected to the magazine housing 130. The plug adaptor 129 further has at least one tool slot 132 to have a brush tool, a prong tool, a plug tool and/or one bore to allow tool movement from a tool slot actuator 133. The tool slot actuator 133 may be rotated by a remote operated vehicle (ROV). In some embodiments, the brush tool may be installed on a wire line tool or rigid chain actuator 125 prior to installation of the system. The brush tool may be lowered into the VXT 127 using the wireline tool or the rigid chain actuator 125. A plug profile 134 in which the plug is to be installed may be brushed with the brush tool. The brush tool may be parked in a third receptacle of the shuttle. The plug tool with an attached plug may be removed from a second receptacle of the shuttle. The plug may be installed in the plug profile of the VXT 127. The plug tool may be disengaged from the plug and parked in the second receptacle of the shuttle. The prong tool with an attached prong may be removed from a first receptacle of the shuttle. The prong tool may be installed. The prong tool may be disengaged from the prong and parked in the first receptacle of the shuttle. As the steps of the method are performed, the chambers of the shuttle may be aligned with the adapter bore as necessary.

Further shown by FIG. 8, when the rigid chain actuator 125 is actuated, the rigid chain actuator 125 will extend down the WP 126 to engage a plug 134 or an internal tree cap (ITCH). It is further envisioned that the plug 134 may include an exploration stem (not shown). The WP 126 may further include a return reservoir 135 which may hold fluid displaced from the wellbore during wellbore operations. In one or more embodiments, the return reservoir 135 may include multiple tanks disposed around the WP 126 and configured to maintain balance of the system. The fluid may be returned from the return reservoir to the wellbore after the wellbore intervention. Also shown by FIG. 8, a mechanical running tool 136 is disposed on top of the plug adapter 129. One skilled in the art will appreciate how the WP 126 of FIG. 8 using the rigid chain actuator 125 creates a compact layout for subsea use. It is further envisioned that the rigid chain actuator 125 may not be directly linked to the surface. For example, if the drilling vessel or offshore platform moves, the rigid chain actuator 125 may stay connected to the well-read 128 without deviating in the well-read 128 with respect to the movement of the drilling vessel or offshore platform moves. Additionally, the rigid chain actuator 125 may include one or more mechanical connections (e.g. a hydraulic link on a sea floor, auxiliary cables, etc.) To have a direct link to the rigid chain actuator 125.

Figure 9A:
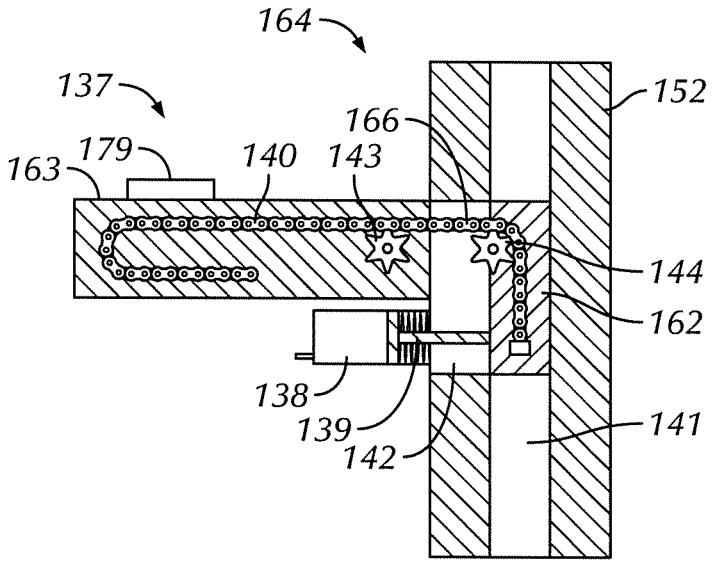
FIGS. 9*a*-9*b* are schematic views of an actuator sliding system in accordance with the present disclosure.
Figure 9B:
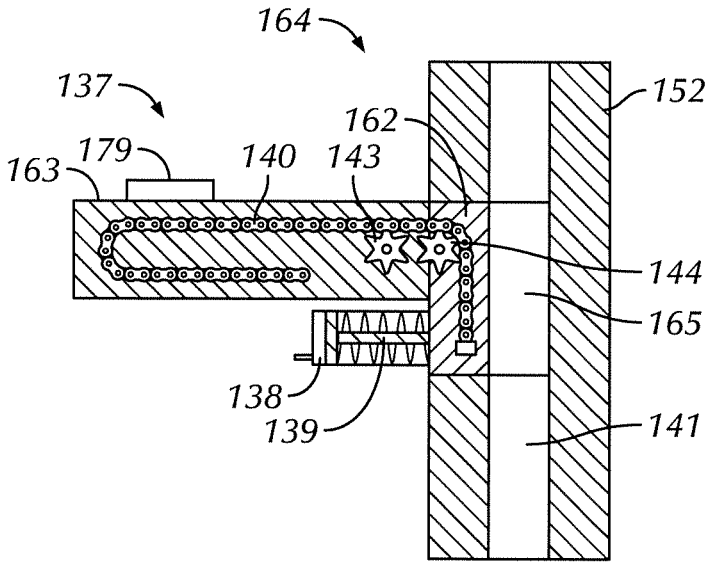

Now referring to FIGS. 9*a*-9*b*, in one or more embodiments, a rigid chain actuator 137 is shown with a chain slide actuator 138. The rigid chain actuator 137 may include a tool body 164 having a bore 141, which may be connectable to upstream or downstream wellbore equipment, or may be integral with wellbore equipment, such as the plug adapter 152, as illustrated. The rigid chain actuator 132 body 164 may include a pocket 142 for stowage of a movable container 162 for when a rigid chain 140 is not needed. When the rigid chain 140 is needed to perform a desired wellbore operation, the movable container 162 may be extended, such as via piston 139 to dispose the rigid chain 140 into a central portion 165 of bore 141. Following use, the rigid chain 140 may be retracted into a magazine housing 163, and movable container 162 may be positioned within pocket 142.

In some embodiments, the rigid chain actuator 137 is connected to a plug adapter 152 in a Riderless Light Well Intervention (RLWI) Stack (not shown). While the RLWI Stack is mentioned for FIGS. 9*a*-9*b*, the chain slide actuator 138 is not limited to only being used with the RLWI Stack and may be used on any other wellbore device. In some embodiments, the chain slide actuator 138 is attached to the plug adapter 152 or integrated as a part of the rigid chain actuator 137 to engage the rigid chain actuator 137 to allow direct access to a well (not shown). Direct access to the well is achieved by the chain slide actuator 138 moving a piston 139 to displace the movable container 162, which is holding a portion of the rigid chain 140. In FIG. 9*a*, the piston 139 is activated and the piston 139 is holding the movable container 162 in the central portion 165 of bore 141 to allow the rigid chain 140 access to the wellbore 141, i.e., extended position. Additionally, when access to the wellbore 141 is needed, such as from above the rigid chain actuator 137, the piston 139 may be compressed, moving the movable container 162 into the pocket 142 of the plug adapter 152, i.e., retracted position, as shown by FIG. 9*b*. While the pocket 142 and rigid chain actuator 137 are shown as being formed integral with the plug adapter 152, it is further envisioned that the rigid chain actuator and chain slide actuator may form a stand-alone piece of equipment attachable to the well-read, Christmas tree, or otherwise connected to the wellbore to perform a desired operation. In such an embodiment, a tool body 164, having pocket 142, is attached to a magazine housing 163 or the magazine housing 163 is built to have the pocket 142 integrated within the magazine housing 163. In some embodiments, a position sensor (not shown) is within the plug adapter 152 to indicate the position of the rigid chain 140. The position sensor aids in preventing damage to the elements described herein, as the position sensor indicates if the rigid chain 140 and/or the piston 139 is in the extended or retracted position.

Further shown by FIGS. 9*a*-9*b*, in one or more embodiments, the rigid chain actuator 137 includes two sprockets, a drive sprocket 143 and a guide sprocket 144 to engage the rigid chain 140. The drive sprocket 143 may be disposed in the magazine housing 163 and the guide sprocket 144 may be disposed in the movable container 162. Additionally, the drive sprocket may be disposed in the movable container 162. It is further envisioned that the present disclose is not limited to two sprockets and may have as many sprockets as needed. The drive sprocket 143 aids the rigid chain 140 in moving (extending and recoiling) while the guide sprocket 144 aids the rigid chain 140 in directing the rigid chain 140 to the appropriate position, guiding the rigid chain 140 through a chain conduit (not shown) between the magazine housing 163 and the bore 141. Furthermore, the drive sprocket 143 may allow for the rigid chain 140 to move within the movable container 162 and magazine housing 163 as the movable container 162 is moved between the extended and retracted position when extending or retracting piston 139. For example, after performing a desired operation, the chain may be retracted to a hard stop (not shown) within the movable container 162. As the movable container 162 is retracted, drive sprocket 143 may remain in a fixed position, and the guide sprocket 144 may allow a length of the rigid chain 140 to extend into a terminal portion (not shown) of chain conduit (not shown), thereby allowing the movable container 162 to be retracted without the rigid chain 140 interfering with the pocket 142 attaining a full retracted position. Other configurations for chain stowage during extension and retraction may also be used. Additionally, one or more sensors 179 may be attached inside or outside on the rigid chain actuator 137. The one or more sensors 179 send various data to the surface. For example, the various data may include the rigid chain 140 wear, the rigid chain 140 position, force generated by the rigid chain 140, sprocket (143, 144) wear, internal pressure of the rigid chain actuator 137, the chain slide actuator 138 position, and/or any parameters of the rigid chain actuator 137 needed by the surface.

Figure 10A:
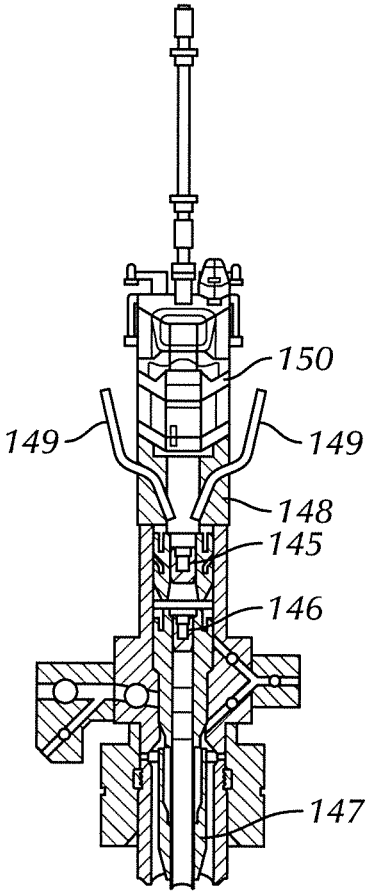
FIGS. 10*a*-10*e* are partial cross-section views of a system including a rigid chain actuator in accordance with the present disclosure.
Figure 10B:
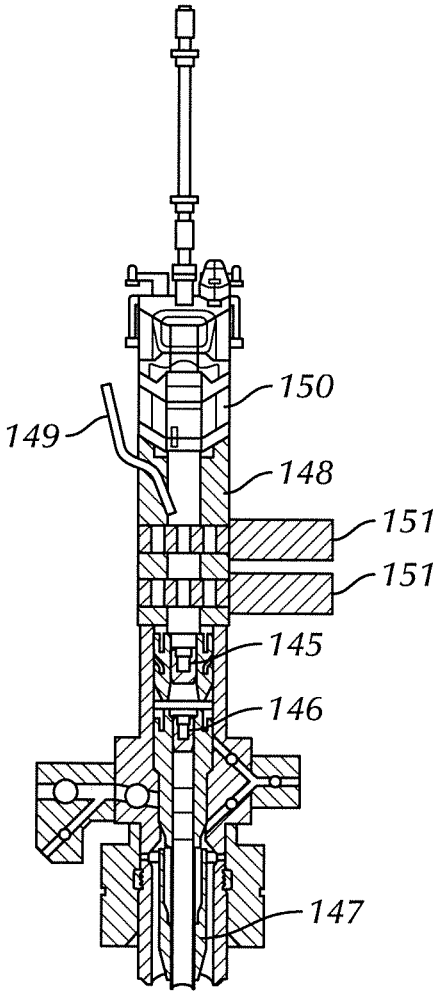
Figure 10C:
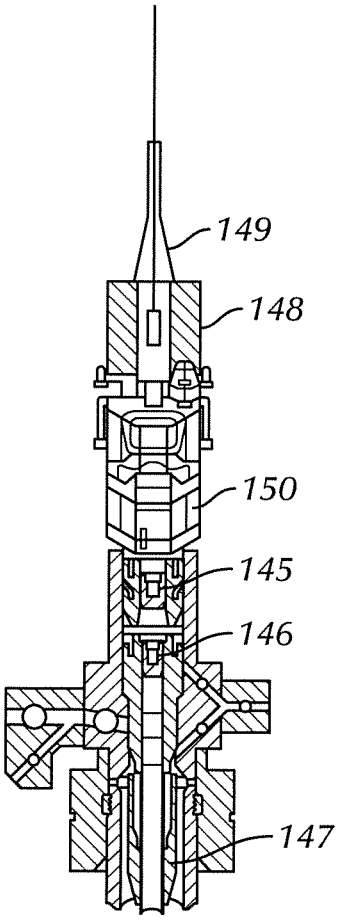
Figure 10D:
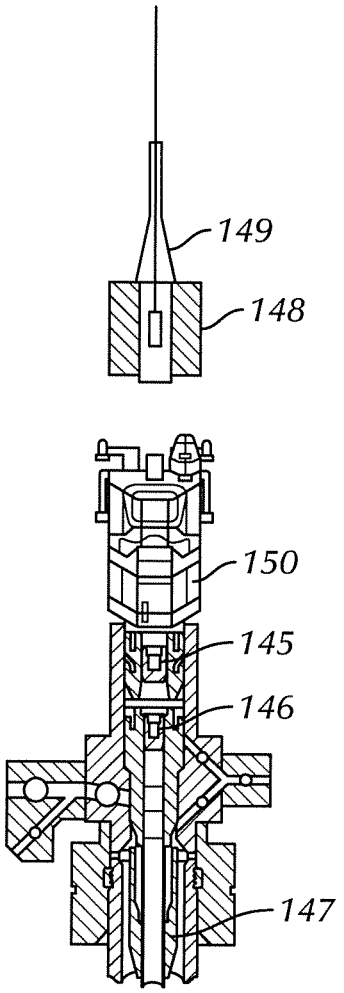
Figure 10E:
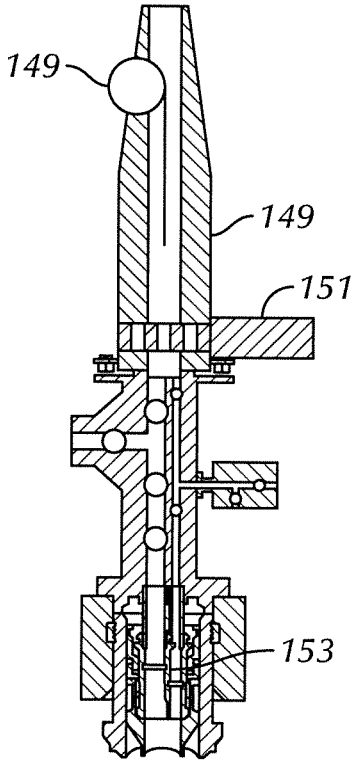

Now referring to FIGS. 10*a*-10*e*, in one or more embodiments, FIGS. 10*a*-10*e* show partial cross-section views of a subsea system including a rigid chain actuator 149. Typically, there are up to two crown plugs (a first crown plug 145 and a second crown plug 146, which are an upper and lower plug, respectively) in a HXT 147. Furthermore, two crown plugs are shown; however, the system is not limited to any set number of crown plugs. Since there are two crown plugs, four functions need to be accounted for. Specifically, the four functions are: pulling the first crown plug 145 and storing the first crown plug 145 in a plug adapter 148; pulling the second crown plug 146 and storing the second crown plug 146 in the plug adapter 148; installing a new second crown plug (See FIG. 3) in the HXT 147; and installing a new first crown plug (See FIG. 3) in the HXT 147. As such, there is a variety of ways to perform the four functions with the rigid chain actuator 149 and plug adapter 148. For example, as shown in FIG. 10*a*, four rigid chain actuators 149 may be connected to the plug adapter 148. For simplicity purposes, to show a clear Figure, only the path of two rigid chain actuators 149 is shown. Additionally, while not shown, one of ordinary skill would understand an internal tree cap (ITCH) may be engaged by the rigid chain actuators 149. By having four rigid chain actuators 149, two rigid chain actuators are for pulling and holding the existing crown plugs in the HXT, and the other two rigid chain actuators are for installing two new crown plugs, which are stored in the plug adapter 148, in the HXT 147 after an intervention job is completed. It is further envisioned that the present disclosure is not limited to four rigid chain actuators and only requires at least one rigid chain actuator. In an alternative embodiment, as shown by FIGS. 10*c*-10*d*, the plug adapter 148 may be placed above a well control package (WP) 150. In such a case, the rigid chain actuators 149 may retrieve and hold a crown plug in the plug adapter 148 (See FIG. 10*d*). Furthermore, once the crown is held the plug adapter 148, the plug adapter 148 may be removed from the WP for any operation needs (See FIG. 10*d*). In an alternative embodiment, as shown by FIG. 10*b*, the plug adapter 148 has one rigid chain actuator 149 and a two-crown plug "plug and park" devices 151 to hold the new crown plugs and park the spent crown plugs (as described in FIGS. 1-3). Furthermore, as shown by FIG. 10*e*, the plug adapter 148 and the rigid chain actuator 149 may be used with a subsea vertical Christmas tree (VXT) 153. It is further envisioned that the embodiments described herein may be used with subsea acid stimulation isolation valve package. One skilled in the art will appreciate how the rigid chain actuators 149 may be installed vertical or horizontal on the HXT 147 or the VXT 153. Additionally, once installed, the rigid chain actuators 149 may be turned to allow the chain of the rigid chain actuators 149 to access the HXT 147 or the VXT 153.

Figure 11B:
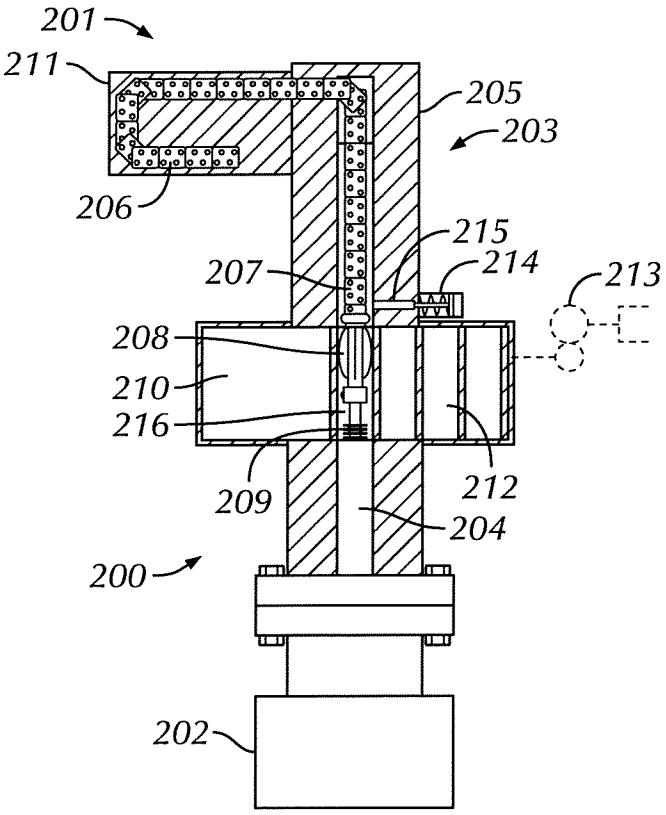
FIGS. 11*a*-11*e* are schematic side views of a system including a rigid chain actuator in accordance with the present disclosure.
Figure 11A:
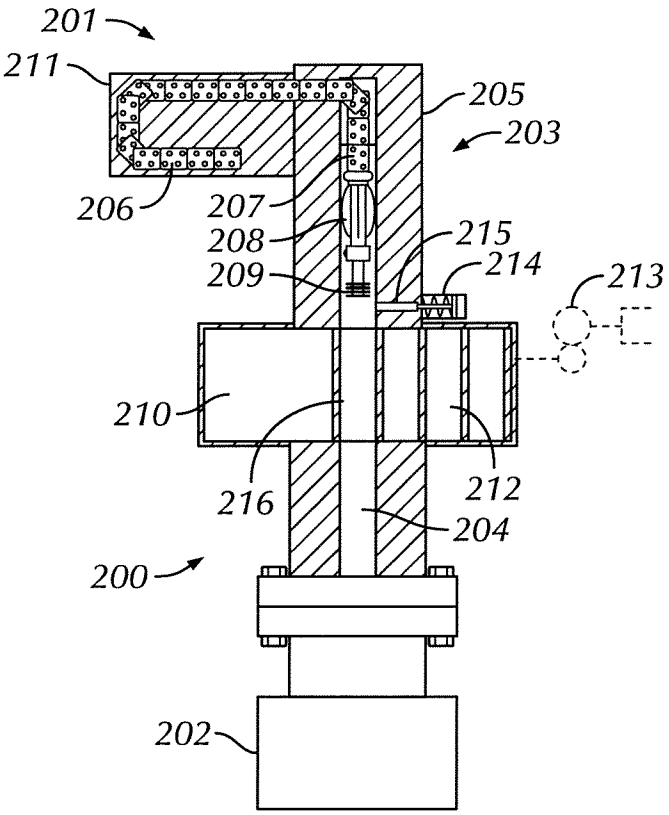
Figure 11D:
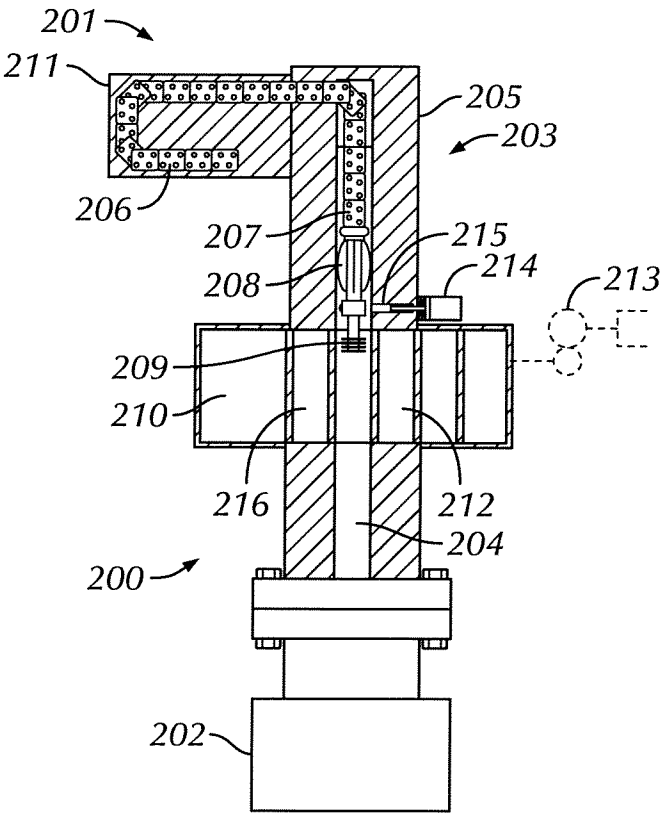
Figure 11C:
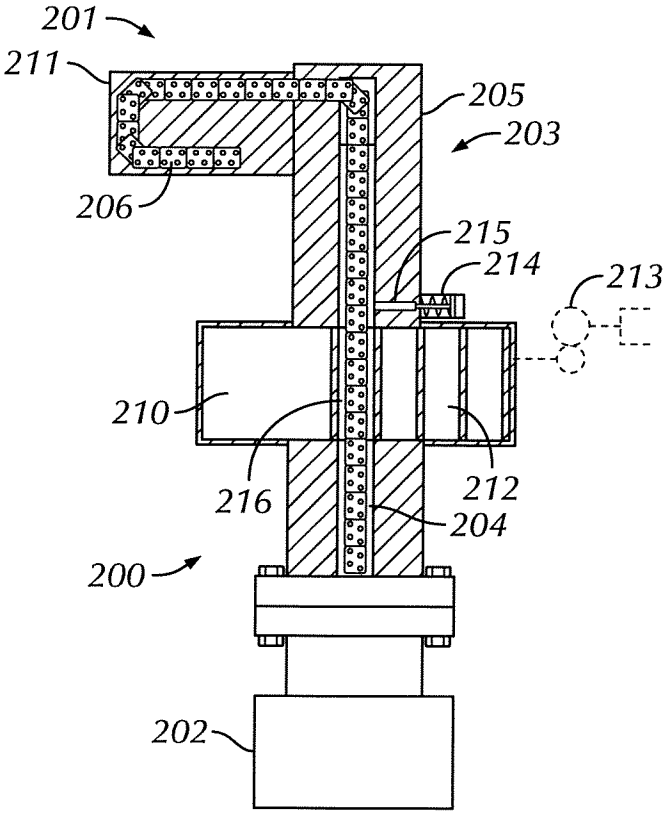

Now referring to FIGS. 11*a*-11*e*, in one or more embodiments, FIGS. 11*a*-11*e* show schematic side views of a subsea system 200 including a rigid chain actuator 201. The rigid chain actuator 201 is shown coupled directly or indirectly to a well-read 202. It is further envisioned that the well-read 202 may be HTX, VXT, or any well-read known in the art. It is further envisioned that the rigid chain actuator 201 may include or be built with a connection adapter (not shown) to be attached to any type of well-read. The rigid chain actuator 201 may include a tool body 203 having a bore 204, which may be connectable to upstream or downstream wellbore equipment, or may be integral with wellbore equipment, such as the plug adapter 205, as illustrated. The rigid chain actuator 201 body 203 may include a pocket (see FIGS. 9*a*-9*b*) for stowage of a movable container (see FIGS. 9*a*-9*b*) for when a rigid chain 206 is not needed. When the rigid chain 206 is needed to perform a desired wellbore operation, the movable container (see FIGS. 9*a*-9*b*) may be extended, such as via piston (see FIGS. 9*a*-9*b*) to dispose the rigid chain 206 into a central portion (see FIGS. 9*a*-9*b*) of the bore 204. Additionally, at an end 207 of the rigid chain 206 may include a plug tool 208 to unlock or lock plugs or tools. As shown in FIG. 11*a*, the rigid chain 206 is in a ready position to be deployed, from a magazine housing 211, into the well-read 202. Once the rigid chain 206 is in the ready position, the rigid chain 206 is deployed to move down the tool body 203, as shown in FIG. 11*b*. Furthermore, the rigid chain 206 engages a plug 209 in a rotative tool slot 210 by translating a force from the rigid chain 206. It is further envisioned the plug 209 may be substituted for any wellbore tool needed in the well-read 202. The rotative tool slot 210 includes a pass thru bore 216 for the rigid chain 206 to move through from the magazine housing 211 to the well-read 202 and may include a plurality of slots 212 to hold or store the plug 209. Additionally, the plurality of slots 212 in the rotative tool slot 210 are able to move side to side in the rotative tool slot 210 with a rotative tool slot actuator 213 attached to the rotative tool slot 210. It is further envisioned that the rotative tool slot 210 may be activated by a remotely operated vehicle (ROV). With the plug 209 or tool engaged, the rigid chain 206 may extend further into the well-read 202 to perform various operations, as shown by FIG. 11*c*. Once in the well-read 202, the rigid chain 206 may install the plug 209 in the well-read 202. For instance, while not shown, one of ordinary skill would understand that the rigid chain 206 may be retracted into the magazine housing 211, once the plug 209 is installed to leave the bore 204 open and be redeployed to retrieve the plug 209.

Figure 11E:
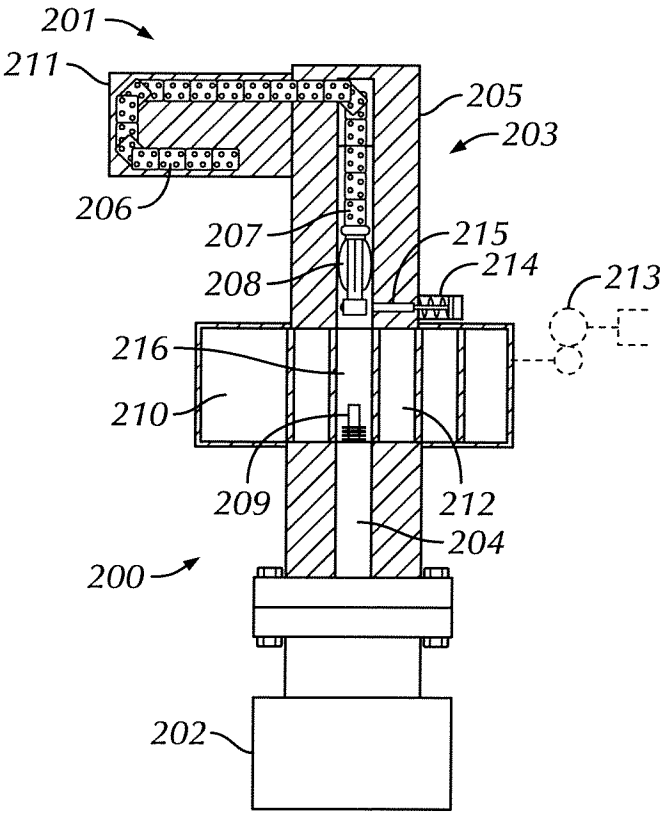

Now referring to FIGS. 11*d*-11*e*, in one or more embodiment, the rigid chain actuator 201 is used to retrieve the plug 209. The rigid chain 206 is deployed into the well-read 202 to retrieve the plug 209 and then, the rigid chain 206 is retracted, with the plug 209, out of the well-read 202, as shown in FIG. 11*d*. Additionally, once the rigid chain 206 with the plug 209 is moved above the pass thru bore 216, the rotative tool slot actuator 213 moves the pass thru bore 216 to have one of the pluralities of slots 212 in line with the rigid chain 206. Furthermore, a finger device or a shifting tool actuator 214 may activate to move a shift tool rod 215 to engage the plug tool 208. The shift tool rod 215 is used to aid the plug tool 208 in releasing the plug 209 into the rotative tool slot 210 to store or hold the plug 209 in the plurality of slots 212, as shown in FIG. 11*e*. Additionally, one or more magnets may be disposed or integrated in the plurality of slots 212 to further stabilize any tool stored or held in one of the plurality of slots 212. As the plug 209 is now in one of the pluralities of slots 212, the shifting tool actuator 214 may move the pass thru bore 216 to be back in line with the rigid chain 206 to allow for access of the well-read 202. It is further envisioned that one or more controls sensor packages (not shown) may be attached to the subsea system 200 on the plug adapter 105 or any tools within the subsea system 200. The one or more controls sensor packages are used to monitor the processes involving the shifting tool actuator 214 and the rotative tool slot actuator 213. Additionally, the one or more controls sensor packages may monitor pressures within all of the subsea system 200 or specifically in the rigid chain actuator 201 and plug adapter 205.

In one or more embodiments, a heat electrical resistor may be attached to the subsea system 200 to prevent hydrates from forming within the subsea system 200 and avoid the stalls in the rigid chain actuator 201. It is further envisioned that the present disclosure is not limited to just a heat electrical resistor and may use various methods and devices, known in the art, to prevent hydrates. For example, the subsea system 200 may be coated, formed, or casted with an insulation material or the subsea system 200 may include a circulation system to regulate the temperatures in the subsea system 200 to prevent hydrates. Hydrates in oil and gas are well known in the art to be an occurrence of hydrocarbon in which molecules of natural gas, typically methane, are trapped in ice molecules (e.g. ice-like solids). More generally, hydrates are compounds in which gas molecules are trapped within a crystal structure. Typically, hydrates form in cold climates, such as permafrost zones and in deep water.

The rigid chain actuator, system, and method disclosed herein may allow wellbore operations involving large bore HXTs to be performed more quickly, inexpensively, and safely. A WP having a smaller diameter bore may be able to be used with such a large bore HXT, possibly reducing the equipment and personnel needed to install the WP. The present disclosure may allow for interventions using smaller, lighter weight intervention systems to be performed from a ship-shape monohull vessel which may have lesser lifting support capacity. The present disclosure reduces the number of times the lubricator must be vented, cleared, flushed, and refilled for each tool run reentry. This may decrease the cost and time needed to prepare for a wellbore intervention and reduce the risk of wellbore fluids escaping into the environment. The present disclosure may also be used in removing and replacing a tubing hanger isolation plug from a tubing hanger associated with a subsea vertical Christmas tree (VXT).

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A system comprising:

a proximal wellbore device;

a wireline tool, disposed within the proximal wellbore device and configured to engage a plug, an internal tree cap, or a wellbore tool; and wherein the wireline tool comprises at least one rigid chain actuator, connected to the proximal wellbore device, comprising:

a tool body having a bore;

a chain at least partially disposed in a housing coupled to the tool body; and a chain extension/retraction mechanism configured to extend the chain from the housing into the bore and recoil the chain from the bore into the housing;

wherein the chain is configured to translate a force onto at least one wellbore tool through the bore and comprises an end portion opposite the housing configured to directly or indirectly engage to the plug, the internal tree cap, or the wellbore tool, wherein the system is disposed on a distal wellbore device comprising one or more plugs, and wherein the distal wellbore device is a horizontal or vertical Christmas tree.

2. The system of claim 1, wherein the rigid chain actuator is connected to a plug adaptor disposed on the horizontal or vertical Christmas tree, the plug adaptor comprising:

an adaptor body comprising:

an adaptor bore; and a shuttle chamber perpendicular to the adaptor bore and intersecting the adaptor bore;

a shuttle disposed within the shuttle chamber, the shuttle comprising two or more chambers including a through-bore and at least one plug receptacle;

an actuator which translates the shuttle within the shuttle chamber; and wherein the plug is a crown plug, and wherein the at least one plug receptacle is configured to hold the crown plug.

3. The system of claim 2, wherein the plug adaptor further comprises:

a second shuttle comprising two or more chambers including a through-bore and at least one plug receptacle; and a second actuator which translates the second shuttle.

4. The system of claim 3, further comprising a second adaptor body and wherein the second shuttle is disposed within a shuttle chamber of the second housing.

5. The system of claim 4, further comprising a rigid chain actuator connected to the second adaptor body.

6. The system of claim 2, further comprising at least one plug and park device connected to the plug adaptor.

7. The system of claim 2, comprising four rigid chain actuators connected to the plug adaptor, wherein two of the four rigid chain actuators are configured to retrieve and holding the at least one plug in the distal wellbore device, and wherein the other two of the four rigid chain actuators are configured to install at least one new plug.

8. The system of claim 1, wherein the proximal wellbore device is a well control package (WCP) of a well intervention system.

9. A method for operating the at least one rigid chain actuator of claim 1, the method comprising:

actuating the chain;

extending the chain from the at least one rigid chain actuator into a wellbore device to install or retrieve the plug, the internal tree cap, or the wellbore tool in the wellbore device, wherein the system of claim 8 is disposed on wellbore device; and recoiling the chain into the at least one rigid chain actuator to have access to the wellbore device.

10. The method of claim 9, further comprising:

engaging a first plug or the wellbore tool attached thereto with the chain or the wireline tool attached thereto to remove the first plug from the wellbore device, and disengaging the chain from the first plug to park the first plug in a plug adaptor disposed on the wellbore device;

recoiling the chain, with the chain extension/retraction mechanism;

performing a wellbore operation;

extending the chain, with the chain extension/retraction mechanism, to engage a second plug with the chain or the wireline tool attached thereto to remove the second plug from the plug adaptor; and actuating the chain of the at least one rigid chain actuator to extend the chain and install the second plug in the wellbore device.

11. The method of claim 10, wherein removing the first plug comprises:

configuring the plug adaptor such that a through-bore of a shuttle is aligned with an adaptor bore; and moving the first plug, with the chain, through the adaptor bore and the through-bore to be upstream of the plug adaptor.

12. The method of claim 11, wherein parking the first plug comprises:

configuring the plug adaptor such that a plug receptacle of the shuttle is aligned with the adaptor bore; and disengaging the chain from the first plug to dispose the first plug in the plug receptacle.

13. The method of claim 12, wherein performing the wellbore operation comprises configuring the plug adaptor such that the through-bore of the shuttle is aligned with the adaptor bore.

14. The method of claim 9, wherein actuating the chain comprises:

actuating the chain extension/retraction mechanism to recoil or extend the chain into and out of the wellbore device; and wrapping or unwrapping the chain in the housing of the at least one rigid chain actuator when the chain extension/retraction mechanism is recoiling or extending the chain, respectively.

15. The method of claim 9, further comprising fitting a plurality of links to fit into a preceding link in the plurality of links and rigidly locking the plurality of links in a lock position by applying an axial force to the chain.

16. The method of claim 15, further comprising forming a rigid column by aligning axes of the plurality of links and unlocking the plurality of links by releasing the axial force.

17. The method of claim 9, further comprising extending a chain slide actuator to position an end of the chain within a bore of the wellbore device and retracting the chain slide actuator to store the chain during a wellbore operation.

* * * * *